United States Patent [19]

Burkstrand et al.

[11] Patent Number: 4,850,169

[45] Date of Patent: Jul. 25, 1989

[54] CEILING RUNNER

[75] Inventors: Lowell E. Burkstrand, Rte. 1, Box 170, Braham, Minn. 55006; George W. Burkstrand, 4335 4th St., Columbia Hgts., Minn. 55421; Theodore S. Haines, Forest Lake, Minn.

[73] Assignees: Lowell E. Burkstrand; George W. Burkstrand, both of Braham, Minn.

[21] Appl. No.: 27,067

[22] Filed: Mar. 17, 1987

Related U.S. Application Data

[63] Continuation-in-part of Ser. No. 848,642, Apr. 7, 1986, abandoned.

[51] Int. Cl.[4] ..... E04B 2/76

[52] U.S. Cl. ..... 52/241; 52/238.1; 52/243; 52/481

[58] Field of Search ..... 52/238.1, 241, 243, 52/667, 664, 481, 483

[56] References Cited

U.S. PATENT DOCUMENTS

| | | | |
|---|---|---|---|
| 1,217,603 | 2/1917 | Jester | 52/243 |
| 1,729,439 | 9/1929 | Gordee | 72/46 |
| 1,982,104 | 11/1934 | Holdsworth | 72/46 |
| 2,078,491 | 4/1937 | Graham | 72/46 |
| 2,079,635 | 5/1937 | Sharp | 189/34 |
| 2,105,771 | 1/1938 | Holdsworth | 72/46 |
| 2,371,921 | 3/1945 | Tucker | 189/34 |
| 2,676,483 | 4/1954 | Nelsson | 72/46 |
| 2,699,669 | 1/1955 | Nelsson | 72/46 |
| 2,834,267 | 5/1958 | Beebe | 94/30 |
| 2,909,251 | 10/1959 | Nelsson | 189/34 |
| 3,027,605 | 4/1962 | Nelsson | 20/4 |
| 3,286,420 | 11/1966 | Lewis | 52/241 |
| 3,332,188 | 7/1967 | Schaefer | 52/349 |
| 3,349,529 | 10/1967 | Byssing | 52/241 |
| 3,461,638 | 8/1969 | Balinski | 52/238 |
| 3,465,488 | 9/1969 | Miller | 52/481 |
| 3,745,732 | 7/1973 | Pritchard et al. | 52/239 |
| 3,986,314 | 10/1976 | Moeller | 52/864 |
| 3,998,027 | 12/1976 | Wendt | 52/716 |
| 4,018,020 | 4/1977 | Sauer et al. | 52/241 |
| 4,448,004 | 5/1984 | Thorsell | 52/486 |
| 4,461,135 | 7/1984 | Anderson et al. | 52/827 |

FOREIGN PATENT DOCUMENTS

| | | | |
|---|---|---|---|
| 2327527 | 12/1974 | Fed. Rep. of Germany | 52/730 |
| 34318 | 4/1965 | Finland . | |
| 2089390 | 6/1982 | United Kingdom | 52/238.1 |

*Primary Examiner*—Michael Safavi
*Attorney, Agent, or Firm*—Schroeder & Siegfried

[57] ABSTRACT

A ceiling runner comprised of an elongated generally U-shaped channel member having longitudinally spaced openings in its web, each with one end portion shaped and sized to confine a transversely arranged upright C-stud therein. The remainder of the opening is of such size and shape as to permit the C-stud to be initially inserted therethrough with the web of its cross-section extending longitudinally of the web of the channel member and to be thereafter twisted about its longitudinal axis to a relatively transverse position to snap into place within said end portion, the web of the channel member having a retaining tab at one side and a detent and camming surface at the opposite side of the opening to cause the C-stud to flex sufficiently to snap into said end portion and to retain the C-stud within said end portion once it has snapped into place. In addition, the channel member has outwardly extending trim flanges at the free ends of its legs which extend beyond the wall-board only in a single plane parallel to the web and have no depending structure, so as to provide an acoustical angle appearance and finished look along the line where the upper edge of the wall meets the ceiling.

6 Claims, 2 Drawing Sheets

FIG. 1
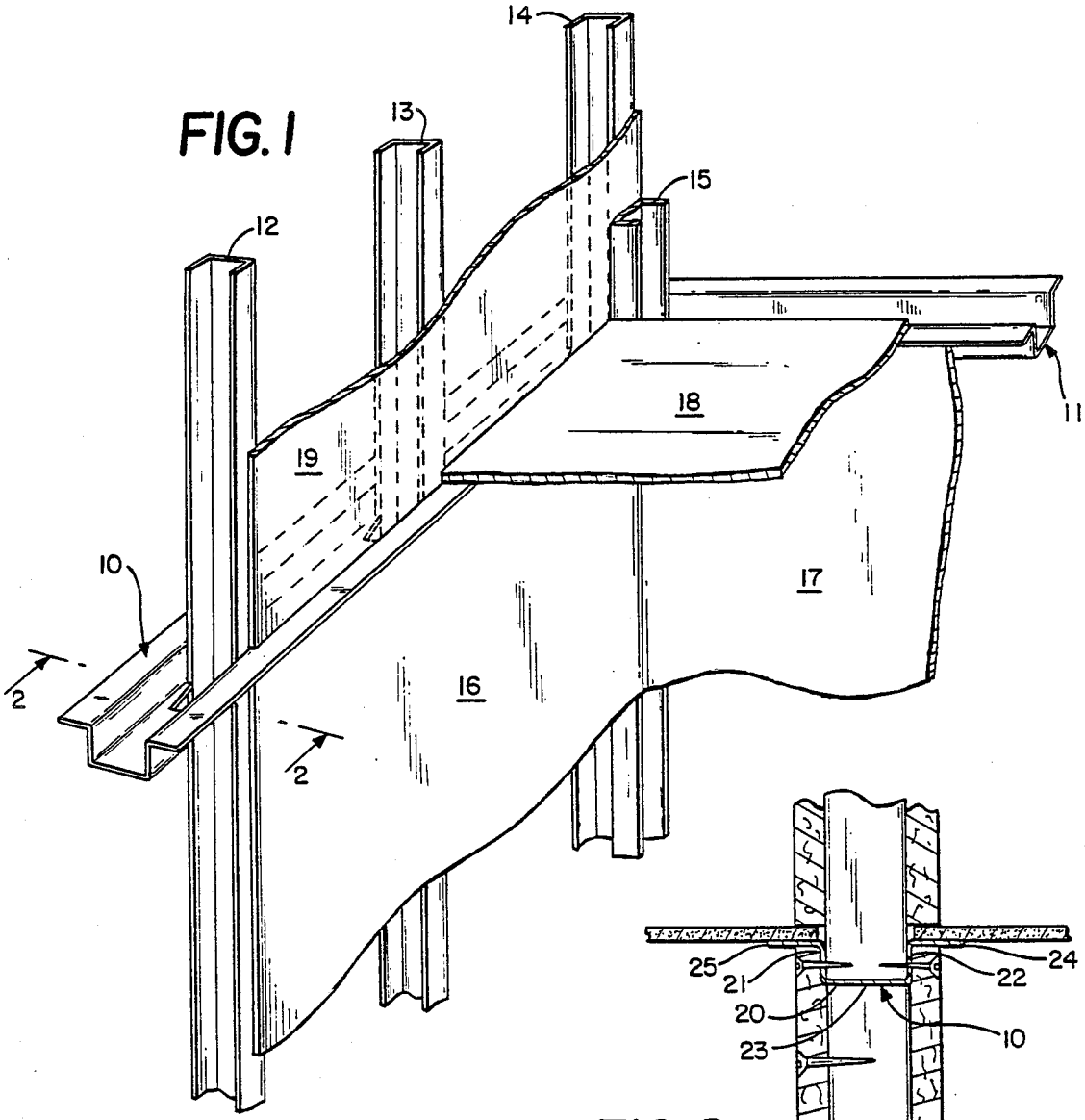
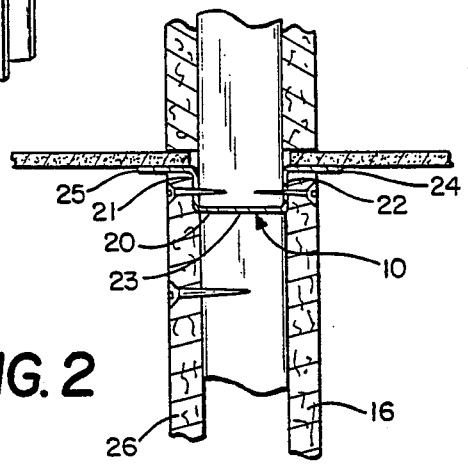
FIG. 2
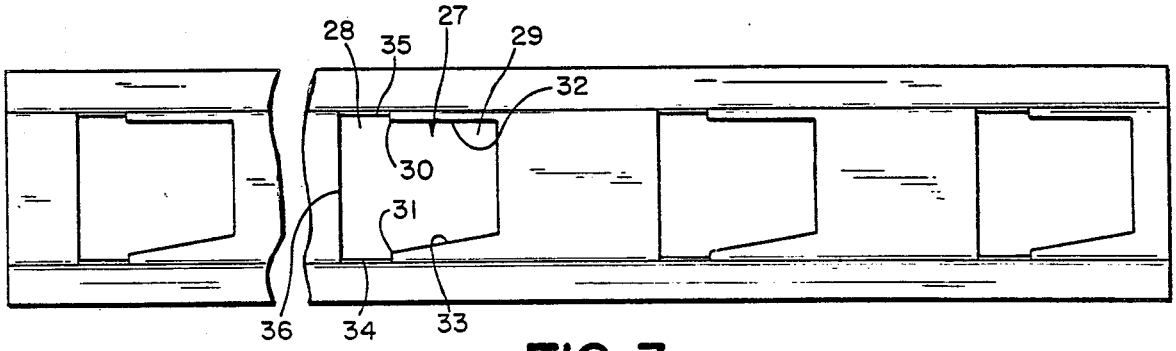
FIG. 3

CEILING RUNNER

DESCRIPTION OF THE PRIOR ART

Applicant claims the benefits of 35 U.S.C. Section 120 with respect to the U.S. patent application Ser. No. 06/848,642, filed on Apr. 7, 1986, and entitled "Ceiling Runner".

The prior art involves the extensive and costly expenditure of much time and labor in order to construct new interior walls, including fire-walls, sound-walls and ceiling. Time, in addition to cost, is frequently of the essence in industrial building construction and hence any effective cuts which can be made in the amount of time required to erect such walls and ceilings is doubly desirable and rewarding.

Present construction procedures and materials utilize metal C-studs secured together at their tops at ceiling level by an inverted channel member into which their upper ends extend and to the legs of which the wallboard, which becomes the interior wall, is secured at opposite sides of the channels. To accomplish this, the channel members at the floor and ceiling must be marked off to properly locate the relative positions of each end of each stud relative to the channel member and thereafter the leg of each stud is secured to the corresponding leg of the channel member through the use of self-tapping screws which extend through the respective leg members. Errors in measuring and marking frequently occur. These procedures require substantial amounts of wasted time and labor. In addition, if perchance one of the studs, prior to their securement to the channel member, is bumped accidentally by another workman, or one is permitted to fall sidewise, a domino effect results with all of the studs falling and a new entire free-stand re-arrangement being required, again involving a waste of time and effort. As a consequence, anything that can eliminate or reduce the amount of time and labor required to provide such an assembly is sorely needed.

In the event any fire-wall or sound-wall is required above the ceiling, present procedures call for measuring the distance each stud is to extend above the ceiling to the overhead deck and then cutting a separate stud to that length. Because of the presence overhead of structural beams, heating and cooling ducts, plumbing, sprinkler pipes, electrical pipes and equipment, etc., these lengths vary and thus much time and labor is consumed in determining the length and location of these relatively short additional studs. Moreover, each stud must be secured somehow at each end, while working under relatively cramped conditions, and the fire-wall or sound-wall must, thereafter, be secured thereto. Because of these problems, the installation of the ceiling grid is sometimes withheld until the room walls and the sound-walls, or fire-walls thereabove have been constructed, which means that the ceiling grid must thereafter be constructed one room at a time, another time-wasting requirement. Also, when the studs are cut to length for the separate fire-wall or sound-wall, the presence of obstacles above the ceiling, such as heat and cooling ducts makes it very difficult to frame straight sound-walls or fire-walls.

Another time and labor consuming problem still besetting the construction industry is that of uneven floors. Such floors cause the length of the studs between the floor and the ceiling to vary. This means that under prior procedures, the length of each stud must be separately measured in advance of cutting it in preparation for placing it in position within the ceiling runner for fastening thereto.

Using present methods, walls are built up only to the ceiling and the trim-molding, commonly called a J-bead or L-bead is applied at the juncture of the wall and ceiling to provide a more finished appearance. The installation of such trim-molding requires a substantial amount of labor and materials. Anything that can be done to reduce or eliminate such procedures will provide a substantial saving.

As indicated above, it is considered desirable to provide a finished appearance at the juncture of the walls and ceiling and toward that end, acoustical angle molding is conventionally applied. Such molding is typically plastic or metal and is comprised of elongated strips which are L-shaped or angulated in cross-section, much like a piece of angle-iron. Such moldings, however, make is difficult, if not impossible, to provide the "revealed edge" at the juncture of the side wall and ceiling, which is considered desirable for uniformity since each of the ceiling panels located more toward the center of the room frequently have such a revealed edge. The "revealed edge" is the edge of the panel which becomes exposed when a strip of the material from which the panel is made is relieved or cut away from the under surface of the panel along, adjacent to, and parallel to the edge of the panel. This is normally provided by a procedure called scribing or rabbeting in which such material is cut away along a straight edge. Since the ends of ceiling panels are conventionally abutted against the side walls of the room, scribing is an awkward, inconvenient, difficult and time-consuming procedure at best. Anything which can be done to obviate this procedure will be welcomed by the industry.

An additional time-consuming and labor-wasting procedure which is currently required is the formation of special openings in the channel members to which the C-studs are secured in order to permit the extension of electrical, telephone and other types of wire therethrough. Currently, such openings are cut as needed and, of course, result in additional cost for labor and the consumption of additional time, which in turn increases the total amount of time required to complete the project.

In order to appreciate the benefits of our new system for framing inner walls, it is important to understand the procedures and materials used in current conventional building practices. Only in this way can the full advantages be recognized. Such practices include the initial laying out of markings on the floor showing wall locations in accordance with the floor plan. This includes plumbing up and markings on the ceiling grid and on the deck, if a fire-wall or sound-wall is to be built above the ceiling. These initial markings are required in all wall building procedures. Thereafter, starting with an outer wall, a drywall ceiling running in the form of an inverted C-channel is secured around the perimeter wall. This is also utilized in our system. At this point, if a sound-wall or fire-wall is to be included above the ceiling, it is necessary to also build a lower runner for the sound-wall or fire-wall, which consists of an upwardly facing channel member secured to the ceiling gridwork directly above the ceiling runner. It is also necessary to build an upper runner (an inverted channel) for the sound-wall or fire-wall immediately below and deck in order to be able to secure the studs for these walls. Because of the presence of numerous obstacles already installed immediately below the deck, such as heating and cooling ducts, electrical wiring, plumbing, etc., the construction of the upper and lower runners for such additional studs above the ceiling gridwork requires a subtantial expenditure of time, labor and materials. With our system, the need for these expenditures is obviated because the fire-walls and sound-walls are automatically framed with the framing of the lower walls, with no additional requirements.

The next conventional step is to secure the floor runners, which are upwardly facing C-channels, along the perimeter walls. Such floor runners are also needed in our system. Thereafter, the spacing of the studs is determined. This involves laying out such spacing by applying markings to the channels of both of the upper and lower runners for both the lower wall and the upper sound-walls or fire-walls. This requires considerable time and effort and is obviated by our system.

The next step is to measure the distances between the lower runner and the ceiling runner in order to determine the length of the studs. Such studs are of uneven length because uneven or non-level floors create differences in such lengths of up to two inches. The studs are then cut according to such measured lengths. This measuring and cutting is obviated by out system.

The cut studs are then stood in place free-stand within the ceiling and floor runners according to the markings, preparatory to securing all of them thereto, first to the ceiling runner at their upper ends and then to the floor runner at their lower ends. Self-tapping screws may be used for this purpose. It is just prior to such secural that a domino effect may cause all of the studs to fall, if one is accidentally tipped sideways by a workman. When this occurs, all of the studs must be repositioned. All of these efforts, including the securing of the studs with self-tapping screws is eliminated by our system.

When each of the perimeter walls have been framed in the above manner, steps are taken to assemble the inner walls which extend therebetween. Toward the end, one end of an inverted C-channel member is conventionally secured to one of the perimeter ceiling runners by cutting away portions of the end so as to leave the web extending over the peripheral ceiling runner to be secured thereto. The inverted C-channel is secured along its length to either the deck or the ceiling grid (if present), after plumbing from the floor markings. Such inverted C-channels are so secured as ceiling runners wherever an inner wall is to be constructed, the end of individual sections being permitted to overlap or otherwise secured together.

When this has been accomplished, the corresponding floor runner consisting of an upwardly facing C-channel is secured to the floor directly below each such ceiling runner. Mark-ings for each stud are then made upon the runners, measurements are made for each stud and then each stud is cut accordingly, if needed. Again, the studs are arranged free-standing within the floor and ceiling runners preparatory to securing same with self-tapping screws, first at their tops to the ceiling runner and thereafter at their lower ends to the floor runner, again with danger of a domino effect in the event one of the studs falls over prior to being secured. Most of the above markings, measurements, securing and cutting operations are obviated by our system.

In conventional wall building, if a sound-wall or a fire-wall is to be built above the ceiling, all of the securing of the runners, the marking, the measurements, the cutting of C-studs to desired length, and the fastening of the studs to the runners must be repeated. All of these operations are obviated by our system because such fire-walls and sound-walls are automatically framed when we frame the lower interior wall. In our system, the studs extend through the one ceiling runner to the deck and are held in fixed position thereby so that there is no need the measurements for the additional studs, or for the additional securing operations.

We are aware of a number of patents, as described herein, which reflect the prior art. U.S. Pat. No. 2,078,491 issued to Graham, shows a U-shaped channel member in FIG. 7 without openings in the web. FIG. 6 thereof shows a skeletonized web having openings 5 to accommodate electrical wiring, etc.

U.S. Pat. No. 2,079,635 issued to Sharp, shows an H-shaped connector member with a hollow central cavity which is used within the hold of a ship to form enclosures.

U.S. Pat. No. 2,371,921 issued to Tucker, shows an elongated angle iron with openings equal in size to hold studs which extend parallel to the length of the angle iron and hence would have only one side to support a wall. It is designed to prevent lateral shifting of cargo within a ship.

U.S. Pat. No. 2,699,669 issued to Nelsson, shows an elongated stud 16 having a transverse web connecting a pair of legs 18, 20 with laterally extending flanges 42, 43. The web has no openings.

U.S. Pat. No. 2,909,251 issued to Nelsson, shows an elongated channel member having a web 12 with legs 15 extending at an acute angle thereto so as to converge. Each leg has a laterally extending flange from which a downwardly converging strip 18 depends. The web has no openings except narrow transverse slots 50 to allow the insertion of studs 44. The runner is one and one-half times the width of the stud and the openings are narrow slots.

U.S. Pat. No. 3,027,605 issued to Nelsson, shows a ceiling runner 60 with flanges 66 and web 36*a* and depending strips 68 which converge. The web has no openings.

U.S. Pat. No. 3,349,529 issued to Byssing, shows a U-shaped channel member without any openings, and having flanges with depending edge moldings. It is used for making a hollow wall partition system. The flanges do not extend in the same plane throughout their length.

U.S. Pat. No. 3,465,488 issued to Miller, shows a U-shaped member having an imperforate web and converging legs.

U.S. Pat. No. 4,018,020 issued to Sauer, shows an imperforate elongated metal channel with no provision for the extension of C-studs therethrough.

U.S. Pat. No. 4,461,135 issued to Anderson et al, shows prior art in FIG. 1 in which a channel member has an imperforate web 15 and depending legs.

BRIEF DESCRIPTION OF THE INVENTION

The problems outlined hereinabove are either eliminated or substantially reduced by our invention, as is evidenced by the enthusiastic endorsement which it has received from large architechural firms and building contractors for the substantial reduction in labor costs which it effects and for the improved aesthetic effects accomplished as a result of its use. These substantial benefits are attained as a direct result of the plurality of equally spaced uniquely shaped openings of the U-shaped ceiling runner which are each shaped to receive an upright C-stud in pierced relation, while the latter is oriented so that its web extends parallel to the length of the web of the ceiling runner. The opening-defining portions of the web of the ceiling runner are shaped so as to cam the legs of the C-stud inwardly and to flex its web when the stud is twisted about its longitudinal axis, whereby the C-stud can snap into transversely extending position past a detent which cooperates with an opposite tab to lock the C-stud in relatively fixed position within one end portion of the opening. The end portion of the openings into which the C-studs are thus snapped is shaped and sized to conform to the cross-sectional shape of the stud, so that the stud is confined and surrounded by the web and held therein. Thus, a wall can be framed in a matter of a few minutes simply by inserting a plurality of C-studs into a plurality of such openings in a pair of our ceiling runners and merely twisting them about their longitudinal axis, thereby locking each of them in place. Since the C-studs extend through our ceiling runner, there is no need to cut the studs even though the floor to ceiling height may be less than the stud length. Since such a ceiling runner can be used at the floor as well as at the ceiling, the lower as well as the upper end portions of the C-stud can be so secured simultaneously.

Since our invention provides for the extension of the C-stud through the ceiling runner, it permits the simultaneous framing of the room wall and the sound-wall or fire-wall, as desired, with substantially less labor. Thus, the C-studs can be inserted within the uniquely-shaped openings to whatever elevation adjacent the upper deck that the obstructions thereat will permit, and the stud can be cut to that length. When the stud has been so cut, it can be snapped into position within the ceiling runner and the lower wall and the fire-wall or sound-wall is thereby completely framed. Thus, a great deal of labor is saved. Moreover, the fire-wall or sound-wall above the ceiling will be straight, and the portion of the stud above the ceiling will already be firmly secured at its lower end within the ceiling runner.

Since the entire wall, including the fire-wall or sound-wall above the ceiling level, is automatically framed simultaneously and quickly by merely snapping the C-studs into position into the uniquely-shaped openings as described above, we have eliminated a great deal of labor because we have eliminated the separate framing of the sound-wall or fire-wall. We have also eliminated the marking or scoring at the ceiling and at the floor for the stud locations. We have also eliminated the need for securing each stud at both levels with self-tapping screws, welding or stud crimpers. Thus, a substantial saving in time is effected and a substantial amount of labort is eliminated.

Heretofore, it has often been impractical to install ceiling grids throughout an entire floor of a new construction, particularly where a substantial number of sound-walls or fire-walls above the ceiling are required. In such instances, ceiling grids are frequently installed room by room, because the grid work interferes substantially with the work required to frame and install the separate fire-walls or sound-walls above the ceiling, thereby making it prohibitively costly. With the use of our new ceiling runner and the automatic framing of the fire-wall or sound-wall which it provides, it is now practical to install the ceiling grids throughout the entire floor at one time. This effects a substantial saving in labor because it is much more cost efficient to install the ceiling grid over an entire area at one time rather than accomplishing the same room by room.

In addition to the above, our ceiling runner has laterally extending edge portions which extend only in a plane parallel to its web and have no depending structure. This configuration provides a finished acoustical angle appearance at the side wall-ceiling juncture which is considered highly desirable in the building trade. It also greatly facilitates the production of the revealed edge of the ceiling panels along the walls, which is also considered highly desirable since it gives a ceiling having panels with revealed edges a uniform appearance throughout the room. The edge portions of our new ceiling runner greatly facilitates the scribing or rabbeting operation which is required to provide a desired revealed edge at the ceiling-wall juncture.

The need for ceiling trim in order to provide a neat finished appearance at the wall-ceiling juncture has been eliminated by our ceiling runner since its edge portions (which extend only parallel to the web and beyond the wall-board and have no depending structure) automatically provides a finished edge-molding appearance, thereby obviating the need for the application of trim-moldings such as the conventional J-bead or L-bead. The separate installation of such conventional beads requires the expenditure of much time and labor and has now been eliminated by our invention.

BRIEF DESCRIPTION OF THE DRAWINGS

A detailed description of one preferred embodiment of the Improved Ceiling Runner is hereafter described with specific reference being made to the drawings, in which:

FIG. 1 is a partial perspective view of one of our Improved Ceiling Runners with a plurality of C-studs extending therethrough and an interior and sound-wall panel secured thereto;

FIG. 2 is a vertical sectional view taken along line 2—2 of FIG. 1;

FIG. 3 is a plan view of one of our Improved Ceiling Runners with an intermediate portion thereof broken away;

DETAILED DESCRIPTION OF THE INVENTION

Figure 4:
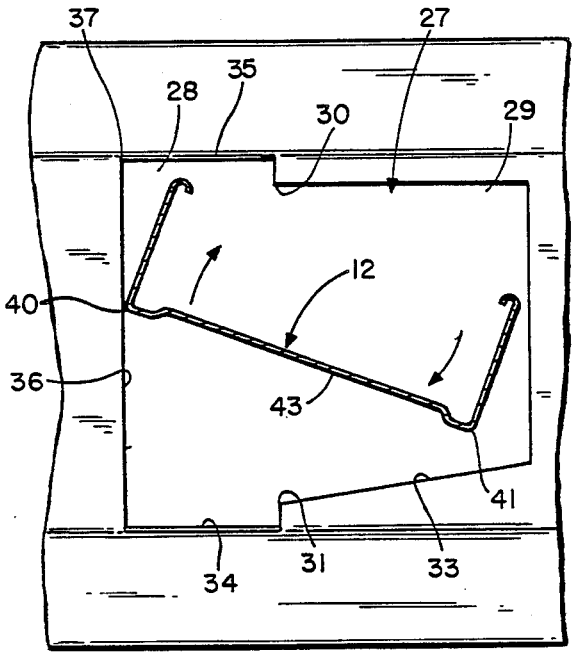
FIG. 4 is a plan view of a portion of one of our Improved Ceiling Runners with a C-stud shown in section as it is initially introduced edgewise into one of the openings thereof.

FIG. 1 shows a pair of our metal ceiling runners 10 and 11 connected at a corner of a room pierced by a plurality of C-studs 12, 13, 14 and 15 which, in turn support a pair of interior wall panels 16, 17, a ceiling panel 18, and a panel 19 of a sound-wall. This figure illustrates the manner in which our ceiling runners are utilized and appear once the C-studs have been received therein and the framing of the wall has been completed.

FIG. 2 shows a cross-sectional view of one of our ceiling runners. As shown, it consists of an elongated U-shaped channel member 20 which is characterized by a pair of leg elements 21, 22 which are joined by a transverse web element 23 that forms the bottom of the channel.

The free-ends of the legs 21, 22 carry outwardly extending edge portions 24, 25 identified as trim flanges. These flanges 24, 25 extend throughout the length of the channel member 20 and beyond the panels of wallboard 16 and 26, as shown. They are approximately 1 ½ inches in width. The standard thickness of wallboard panels such as 16 and 26 is ⅝ inch. The flanges 24, 25 each extend parallel to the web 23 throughout their entire length and, as shown, have no depending structure connected to their outer and free edges.

As best shown in FIG. 3, our ceiling runner is provided with a plurality of generally rectangular openings, the longer dimensions of which extend longitudinally of the channel member 20 and web 23. As described hereinafter, the longitudinal dimension of these openings is at least as great as the transverse dimension of the end portion thereof which eventually receives the C-stud 12 therein in locked-in relation. Preferably, the longitudinal dimension is slightly greater than such transverse dimension in order to facilitate initial insertion of the C-studs into these openings. These openings are spaced at eight (8") centers throughout the length of the runner.

As shown, the openings 27 are generally rectangular in shape, and have opposite end portions 28 and 29. The most important characteristic thereof is that one of said opening end portions, the end portion 28, is shaped and sized so as to receive and confine a C-stud 12 therein in relatively fixed position. This is accomplished, as shown, by shaping the end portion 28 so as to conform to the exterior shape of a conventional C-stud 12 and to size it so that it is only slightly larger, and to hold the stud therein with a retaining tab 30 and a detent 31.

As shown, the web 23 has opening-defining portions identified generally by the numeral 32 and the retaining tab 30 and detent 31 are part of such opening-defining portions. In addition, the edge portions just outwardly of the detent 31 and extending away from the end portion 28, constitute a camming surface 33. The end portion 28 has opposite ends 34 and 35. A transverse edge 36 constitutes a back wall against which the C-stud 12 abuts, and forms a corner 37 with the end 35 which is located opposite the detent 31.

Figure 5:
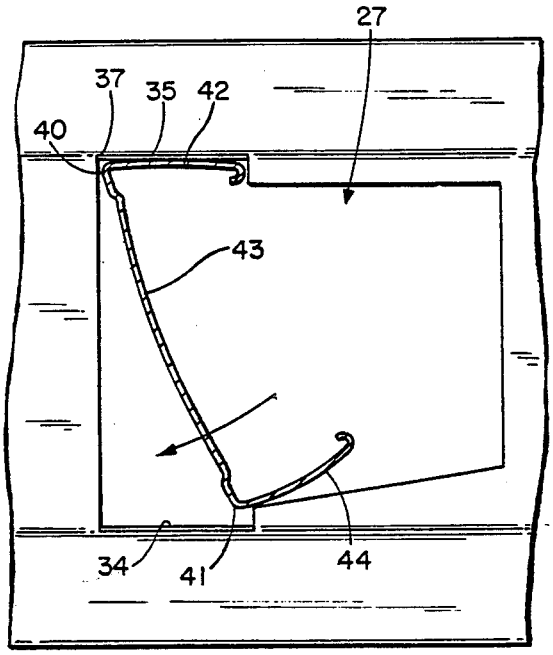
FIG. 5 is a plan view of the same portion of one of our Improved Ceiling Runners with the same C-stud as that in FIG. 4, shown in section in a second and flexed position as it is being twisted about its longitudinal axis and cammed into one end portion of the opening.
Figure 6:
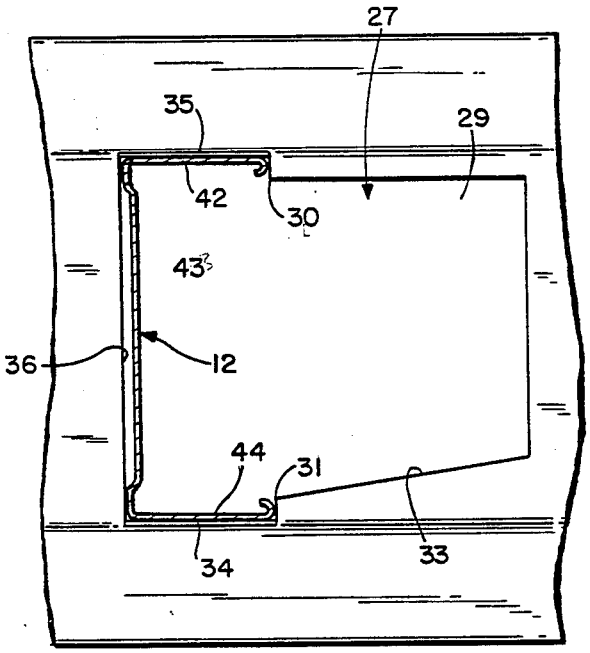
FIG. 6 is a plan view of the same portion of one of our Improved Ceiling Runners with the same C-stud as that in FIGS. 4 and 5, shown in section in final locked-in position within said one end portion of the opening to complete its installation as part of the framing of the wall.

Reference to FIGS. 4–6 will reveal how our ceiling runner enables a worker to frame an inner wall and a sound-wall or fire-wall simultaneously, quickly and easily. After the ceiling runner has been mounted so as to extend along beneath the ceiling grid, as hereinbefore described, a plurality of C-studs, such as C-stud 12 are inserted through the openings 27 and snapped into place. FIG. 4 shows how the C-stud is oriented initially. It will be seen it will be inserted edgewise with its longest dimension extending longitudinally of the opening to facilitate entrance. Once it has been inserted to its fullest extent, it is twisted about its longitudinal axis, as shown by the arrows so that its leading corner 40 will engage the rear or back wall 36 and its trailing corner 41 will engage the camming surface 33. The latter urges the leading corner 40 into the corner 37 of the opening so that the leg 42 of the C-stud bears against the end 35. As can be seen by reference to FIG. 5, the leg 42 flexes substantially relative to the web 43 which also flexes slightly. The opposite leg 44 also flexes as it slides past the detent 31, as shown.

Once the corner 41 of the stud passes the detent 31, the entire stud snaps into locked position, as shown in FIG. 6. It will be seen that the retaining tab 30 and detent 31 positively lock the C-stud in place in closely-confined relation. No further connection to the ceiling runner is required. This procedure is repeated for each stud and requires only a few seconds each, so that an entire wall can be framed in a manner of a few minutes. It will be seen that the studs, which extend up to the deck above for the fire-wall or sound-wall to be constructed above the ceiling, are automatically thereby framed since the upper end portions of the C-stud are held in fixed and true upright position by the ceiling runner. All that remains to complete the walls is to affix the wall board to the legs of the studs, above and below the ceiling runner, in any manner desired.

It will be seen that the distance between the tab 30 and detent 31 is less than the transverse dimensions of both the opening end portion 28 and the C-stud 12. Also, the distance between the detent 31 and all portions of the end 35 is less than such transverse dimensions.

Figure 7:
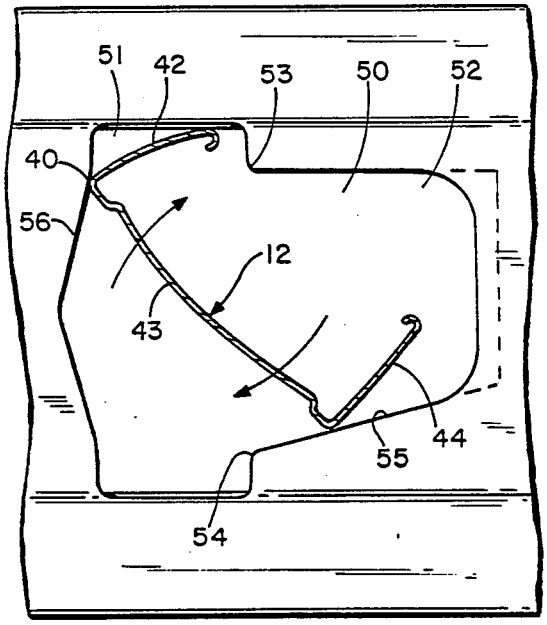
FIG. 7 is a plan view of a portion of another form of an Improved Ceiling Runner having a generally T-shaped opening and with a C-stud shown in section in a position corresponding to that of the stud shown in FIG. 4.

FIG. 7 shows a portion of a ceiling runner having the same cross-sectional shape as shown in FIGS. 1-6 with a modified form of opening 50. As shown, it is generally T-shaped and has one end portion 51 which corresponds to the cross-bar portion of the letter T, and a second end portion 52 which corresponds to the depending leg of the T. It includes a tab 53, a detent 54, and a camming surface 55, as well as a rear wall 56. The C-stud is snapped into locked position in the same manner as hereinbefore described. The opening is longer in its longitudinal dimension than its transverse dimension and the end portion 51 is shaped and sized generally to conform to the exterior of the C-stud. The primary difference over that shown in FIGS. 1–6 is the convex shape of the rear wall 56.

It will be seen that the intermediate portions of the rear wall 56 are slightly convex. The leading corner 40 of the C-stud engages this surface and the latter adds a more longitudinal thrust to the leg 42 as the C-stud is twisted about its longitudinal axis, thereby facilitating installation of the C-studs. Once the C-stud has snapped into full transverse locked position, it is held thereat by the restraining tab 53 and detent 54.

Reference to FIG. 2 reveals the substantial improvement provided by our ceiling runner with respect to aesthetic effects. It will be seen that the trim flanges 24 and 25 extend laterally outwardly beyond the conventional wallboard 16 and 26 so as to provide a neat and finished effect which obviates the need for the application of strips of J-bead or L-bead edge-moldings. Also, the outer edges of these flanges greatly facilitates the scribing operation which provides the "revealed edge" of the ceiling panel along the wall-ceiling juncture. Thus, a substantial amount of material and labor is saved.

From the above, it can be seen that through the use of our improved ceiling runner, substantial time and labor savings can be accomplished in that the markings, the securing operations, the separate construction of the fire-wall or sound-wall and the need for separate edge-molding have been eliminated. In addition, the fire-walls or sound-walls will be straight and substantial quantities of material will be saved. Moreover, the end product will have a much more pleasing aesthetic effect.

In considering this invention, it should be remembered that the present disclosure is illustrative only and the scope of the invention should be determined by the appended claims.

What is claimed is:

1. A ceiling runner for securing a plurality of C-studs in parallel up-right wall-supporting position for supporting walls, ceilings and fire-walls thereabove comprising:

(a) an elongated channel member which is generally U-shaped in cross-section and has a pair of leg elements with inner ends joined by a transverse web element;

(b) said web element having a plurality of stud-receiving openings formed therein and spaced equally longitudinally thereof;

(c) said web element having opening-defining surfaces defining said openings;

(d) each of said openings having longitudinal dimensions at least as great as the transverse dimensions thereof relative to said channel member and having one end portion of generally rectangular shape extending transversely of said web element;

(e) a plurality of vertically extending C-studs, each of said C-studs being locked within one of said rectangular end portions in close-fitting surrounded relation;

(f) said C-studs having portions thereof extending upwardly through said openings of said channel member a substantial distance above said channel member, each of said C-studs having a pair of opposed legs and a web extending therebetween;

(g) a plurality of stud-retaining tabs, each of said stud-retaining tabs being carried by an opening-defining surface of said web element adjacent one of said C-studs and engaging and retaining said C-stud within said rectangular end portion;

(h) a plurality of detents, each of said detents being carried by an opening-defining surface of said web element and extending inwardly opposite one of said tabs in cooperative stud-locking relation with said tab and engaging and locking one of said C-studs within one of said rectangular end portions in close-fitting surrounded relation and in vertically extending position;

(i) the distance between each of said detents and the tab opposite said detent being less than the transverse dimensions of the web of one of said C-studs;

(j) a plurality of camming surfaces, each of said camming surfaces being carried by said opening-defining surfaces adjacent one of said detents and extending away from said detent; and (k) a wall secured to said portions of said C-studs and extending upwardly from and above said channel member.

2. The structure defined in claim 1 wherein the longitudinal dimensions of each of said openings exceeds the transverse dimensions of said opening.

3. The structure defined in claim 1 wherein each of said tabs is an integral part of said opening-defining surfaces of said web element.

4. The structure defined in claim 1 wherein each of said detents is an integral part of said opening-defining surfaces of said web element.

5. The structure defined in claim 1, wherein said wall is a fire-wall.

6. The structure defined in claim 1, wherein said wall is a sound-wall.

* * * * *

UNITED STATES PATENT AND TRADEMARK OFFICE

CERTIFICATE OF CORRECTION

PATENT NO. : 4,850,169

DATED : July 25, 1989

INVENTOR(S) : Lowell E. Burkstrand, George W. Burkstrand, and Theodore S. Haines It is certified that error appears in the above-identified patent and that said Letters Patent is hereby corrected as shown below:

Column 2, Line 58, change "running" to --runner--

Column 3, Line 41, change "the" to --that--

Column 5, Line 54, change "labort" to --labor--

Signed and Sealed this

Fifteenth Day of May, 1990

*Attest:*

HARRY F. MANBECK, JR.

*Attesting Officer*

*Commissioner of Patents and Trademarks*